US010167117B2

(12) United States Patent
Chang

(10) Patent No.: US 10,167,117 B2
(45) Date of Patent: Jan. 1, 2019

(54) LID

(71) Applicant: RICH CUP BIO-CHEMICAL TECHNOLOGY CO., LTD., Taichung (TW)

(72) Inventor: Ching-Wen Chang, Taichung (TW)

(73) Assignee: RICH CUP BIO-CHEMICAL TECHNOLOGY CO., LTD., Taichung (TW)

( * ) Notice: Subject to any disclaimer, the term of this patent is extended or adjusted under 35 U.S.C. 154(b) by 307 days.

(21) Appl. No.: 15/010,718

(22) Filed: Jan. 29, 2016

(65) Prior Publication Data

US 2016/0145009 A1 May 26, 2016

Related U.S. Application Data

(63) Continuation-in-part of application No. 14/072,232, filed on Nov. 5, 2013, which is a continuation-in-part of application No. 13/419,568, filed on Mar. 14, 2012.

(30) Foreign Application Priority Data

May 5, 2011 (TW) ..... 100115725 A

(51) Int. Cl.
*B65D 43/02* (2006.01)
*B65D 43/06* (2006.01)

(52) U.S. Cl.
CPC ..... *B65D 43/0218* (2013.01); *B65D 43/06* (2013.01); *B65D 2543/00092* (2013.01); *B65D 2543/00296* (2013.01); *B65D 2543/00416* (2013.01); *B65D 2543/00518* (2013.01); *B65D 2543/00555* (2013.01); *B65D 2543/00842* (2013.01)

(58) Field of Classification Search
CPC B65D 43/0218; B65D 43/0256; B65D 43/06; B65D 2543/00092; B65D 2543/00296; B65D 2543/00416; B65D 2543/00518; B65D 2543/00555; B65D 2543/00843
USPC ..... 215/272, 293; 220/780, 784, 786, 788, 220/793, 794
See application file for complete search history.

(56) References Cited

U.S. PATENT DOCUMENTS

| | | | |
|---|---|---|---|
| 4,431,113 | A | 2/1984 | Sims, Jr. |
| 5,538,154 | A | 7/1996 | Von Holdt |
| 6,793,096 | B1 | 9/2004 | Seok |
| 7,731,049 | B2 | 6/2010 | Dengel et al. |
| 7,918,360 | B2 | 4/2011 | Mengeu et al. |

(Continued)

*Primary Examiner* — James N Smalley
*Assistant Examiner* — Madison L Poos
(74) *Attorney, Agent, or Firm* — Muncy, Geissler, Olds & Lowe, P.C.

(57) ABSTRACT

A lid is provided for covering or sealing a cup by engaging a rim flange of the cup. The lid includes a top portion and an annular side plate which extends downwardly from periphery of the top portion. The plate is formed with a hole. An engagement plate is disposed on the side plate. A bottom edge of the engagement plate is connected to the plate. A top edge of the engagement plate stretches upwardly along the hole, so that the engagement plate is located in the hole. The plates are flexible. As such, the engagement plate can be pressed and bent inwardly when the lid covers a cup. The engagement plate would then engage with the rim flange of the cup so as to enhance engagement of the lid and the cup.

4 Claims, 6 Drawing Sheets

(56) References Cited

U.S. PATENT DOCUMENTS

| | | | |
|---|---|---|---|
| 7,946,443 | B2 | 5/2011 | Stull et al. |
| 2006/0163265 | A1 | 7/2006 | De Candido |

LID

BACKGROUND OF THE INVENTION

Field of the Invention

This application is a Continuation-In-Part of prior application Ser. No. 14/072,232, filed Nov. 5, 2013, which is a Continuation-In-Part of prior application Ser. No. 13/419,568 filed Mar. 14, 2012, the entire contents of which are hereby incorporated by reference.

Description of the Prior Art

Conventional lid is prepared with annular inner protruding portion at lower periphery thereof. The protruding portion is able to abut against annular rim flange of a cup.

However, the cup or the rim flange may be deformed when the cup is grabbed by someone. As a result, the cup is probably dropped out from the protruding portion. Moreover, each batch of cups has its own particular specifications established by the suppliers. The standards for the size, the thickness, the height, and the diameter of the rim flanges of cups are different from provider to provider. If the lid is not fit well with the cup, the cup can be dropped out from the lid easily.

To enhance engagement of the lid and the cup, lid, as disclosed in U.S. Pat. No. 5,538,154, is provided with inwardly extending panels which functions as barbs. The panel is able to engage the rim flange of the cup automatically when the lid covers on the cup.

However, engagement of the lid provided in U.S. Pat. No. 5,538,154 is so firm that user can hardly remove the lid when he/she wants to. For removing the lid, cutting lines or projecting tab is provided together with the panel. Consequently, the projecting tab would complicate the lid making the lid difficult to be produced, and the cutting line would damage structure of the lid making the lid fractured once the lid is removed.

Besides, U.S. Pat. No. 4,731,113 disclosed a lid having a similar structure to U.S. Pat. No. 5,538,154. Each of the two disclosures has a tongue which has been protruded above the plane of the side plate inward. The tongue tends to protrude inward. Besides, the tongue has a same thickness to the thickness of the side plate. Thus, the tongue is quite difficult to be deformed or bent. As a result, installing or removing the lid becomes difficult.

The present invention is, therefore, arisen to obviate or at least mitigate the above mentioned disadvantages.

SUMMARY OF THE INVENTION

The main object of the present invention is to provide a lid which is able to cover and engage a cup stably.

To achieve the above and other objects, a lid of the present invention includes a top portion, an annular side plate, and at least an engagement portion.

The annular side plate extends downwardly from a periphery of the top portion. An axial direction and a radial direction perpendicular to the axial direction are defined by the side plate. The side plate is formed with at least a hole.

The engagement portion is disposed on the side plate. The engagement portion comprises an engagement plate. The engagement plate has a bottom edge and a top edge. The bottom edge extends from and is connected to the side plate. The engagement plate extends from the bottom edge upwardly along the hole so that the engagement plate is received in the hole. The engagement plate is bendable. An engagement space is defined in middle of the top portion, the side plate, and the top edge of the engagement plate when the engagement plate is bent inwardly along the radial direction.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
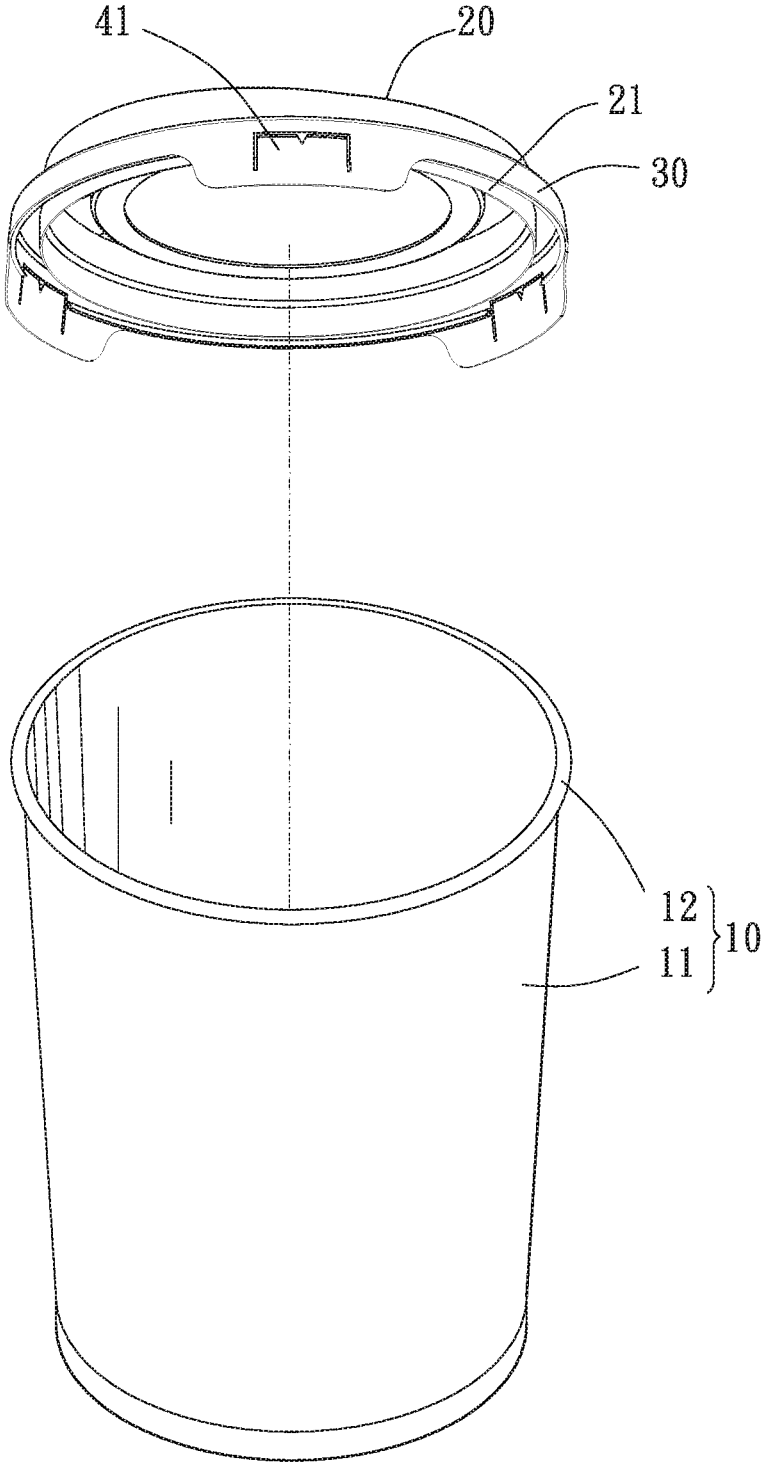
FIG. 1 is a combination drawing showing a cup and a lid of a first embodiment of the present invention.
Figure 2:
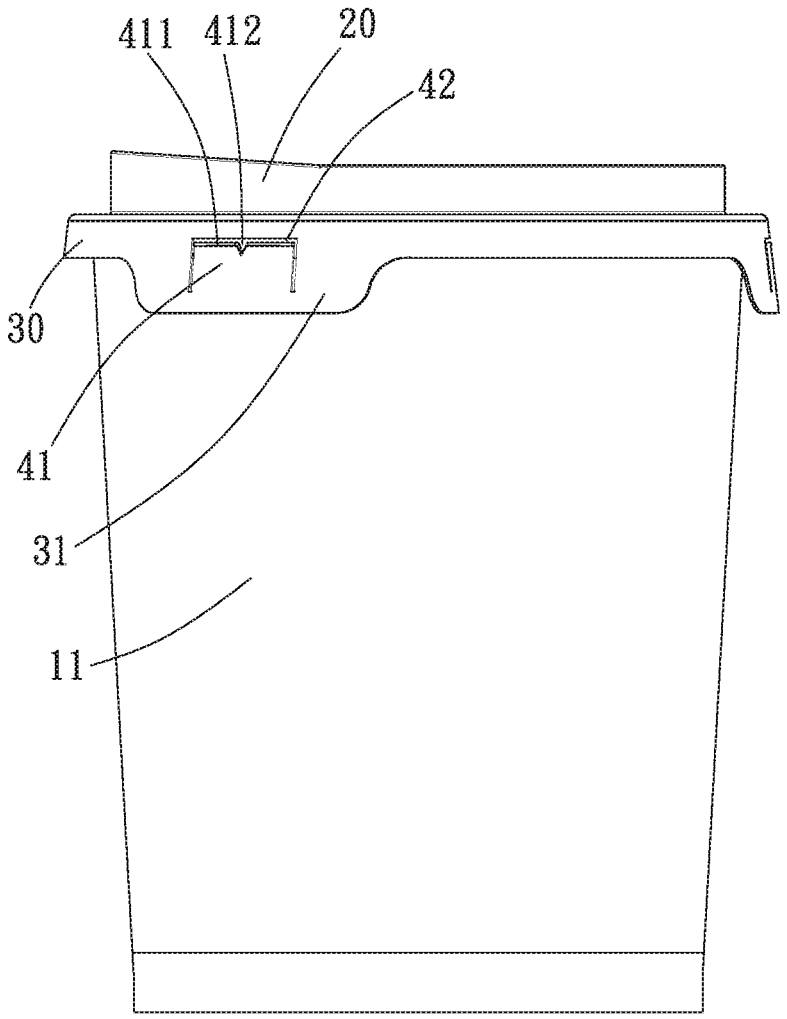
FIG. 2 is a side view showing a cup and a lid of a first embodiment of the present invention.
Figure 3:
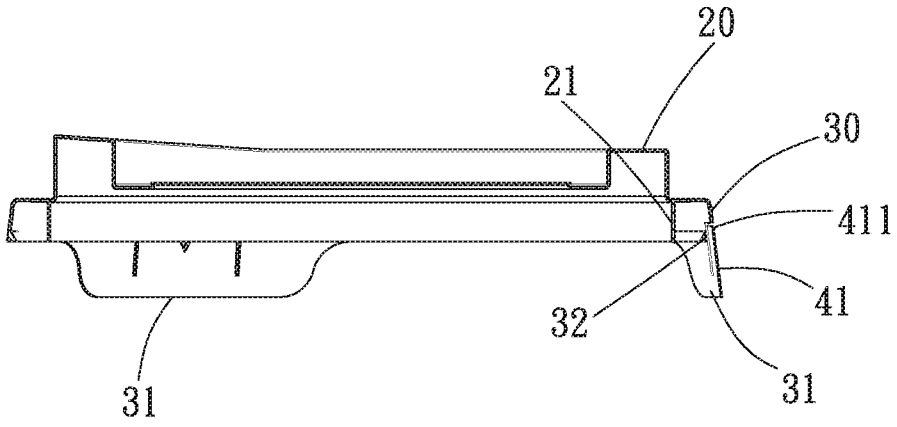
FIG. 3 is a profile showing a first embodiment of the present invention.

Please refer to FIG. 1 to FIG. 3 for a first embodiment of the present invention. The lid of the present embodiment is provided for covering and engaging a cup 10. The cup 10 has a body 11 and a rim flange 12. The body 11 is formed cylindrically with an upper opening. The rim flange 12 is disposed on the body and surrounds the upper opening annularly. The cup 10 may be made of paper, plastic, or other suitable material.

In the present embodiment, the lid includes a top portion 20, an annular side plate 30, and three engagement portions.

The top portion 20 is adapted for covering upon the rim flange 12 and covering the upper opening of the cup 10. The top portion 20 may be formed with suitable grooves, protrusions, or openings for user to drink directly or to drink with a straw. Preferably, the top portion 20 is formed with an additional annular inner plate 21 extending downwardly therefrom. The inner plate 21 is adapted for abutting against inner surface of the cup 10 or inner periphery of the rim flange 12. In other possible embodiments of the present invention, the function of the inner plate 21 may be provided directly by grooved or curved top portion 20.

The annular side plate 30 stretches and extends downwardly from periphery of the top portion 20. The inner plate 21 is then located in the side plate 30. An axial direction and a radial direction are defined by the annular side plate 30. The radial direction is perpendicular to the axial direction. The side plate 30 is further formed with three holes. Preferably, the side plate 30 is further formed with three extension portions 31 protruding downwardly from where the holes are. Additionally, the side plate may be formed with a protruding portion 32 protruding inwardly therefrom. The protruding portion 32 is utilized for abutting against lower periphery of the rim flange 12.

Figure 4:
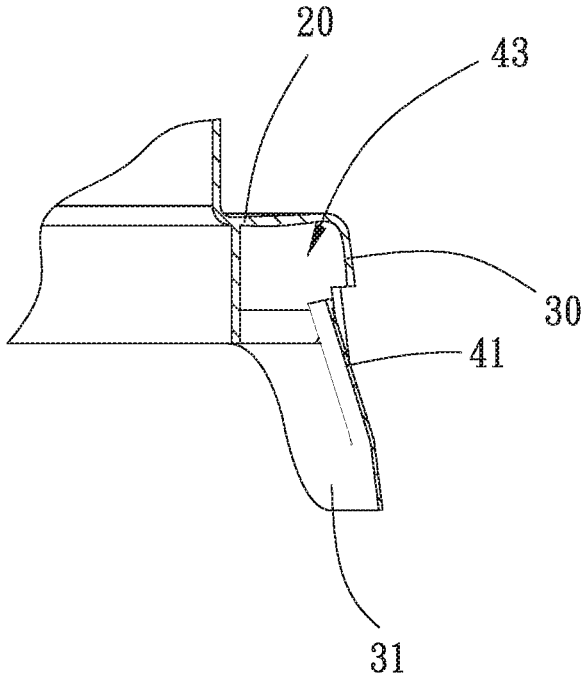
FIG. 4 is a partial enlargement drawing of FIG. 3.

The engagement portions are equidistantly disposed on the side plate 30. Each engagement portion includes an engagement plate 41 which has a bottom edge and a top edge. The bottom edge extends from and is connected to the side plate 30. The engagement plate 41 extends from the bottom edge upwardly along the hole. The engagement plate 41 is then received in the hole. Thus, a reversed U-shaped gap 42 is defined by the engagement plate 41 and the side plate 30 as shown in FIG. 2. Consequently, the side plate 30, the hole, and the engagement plate 41 may be prepared by cutting an intact annular plate so that the side plate 30 and the engagement plate 41 are located at a same plane. That is, the engagement plate 41 does not protrude above the plane of the side plate 30 before being pressed. Moreover, a thickness of the side plate 30 is larger than a thickness of the engagement plate 41 so that the engagement plate 41 is properly deformable for pressing. In the present embodiment, the engagement plate 41 is formed with a protrusion 411 and a notch 412. The protrusion 411 protrudes radially outwardly from the top edge of the engagement plate 41, so that the protrusion 411 is located at the top edge. Preferably, the protrusion 411 is formed as a rib extending along the top edge. Alternatively, the protrusion 411 may protrude radially inwardly from the top edge. The notch 412 is recessed downwardly from the top edge of the engagement plate 41. The notch 412 may be formed in V-shaped notch, as shown in FIGS. 1 and 2, or in semicircular notch. The engagement plate 41 and the side plate 30 are bendable. The engagement plate 41 can be bent inwardly along the radial direction. Thus, an engagement space 43 is defined in middle of the top portion 20, the side plate 30, and the top edge of the engagement plate 41, as shown in FIG. 4.

In the present embodiment, there are three groups of extension portion 31, hole, and engagement portion. In other possible embodiments of the present invention, one or more extension portions 31, holes, and engagement portions can be prepared for the similar function.

Figure 5:
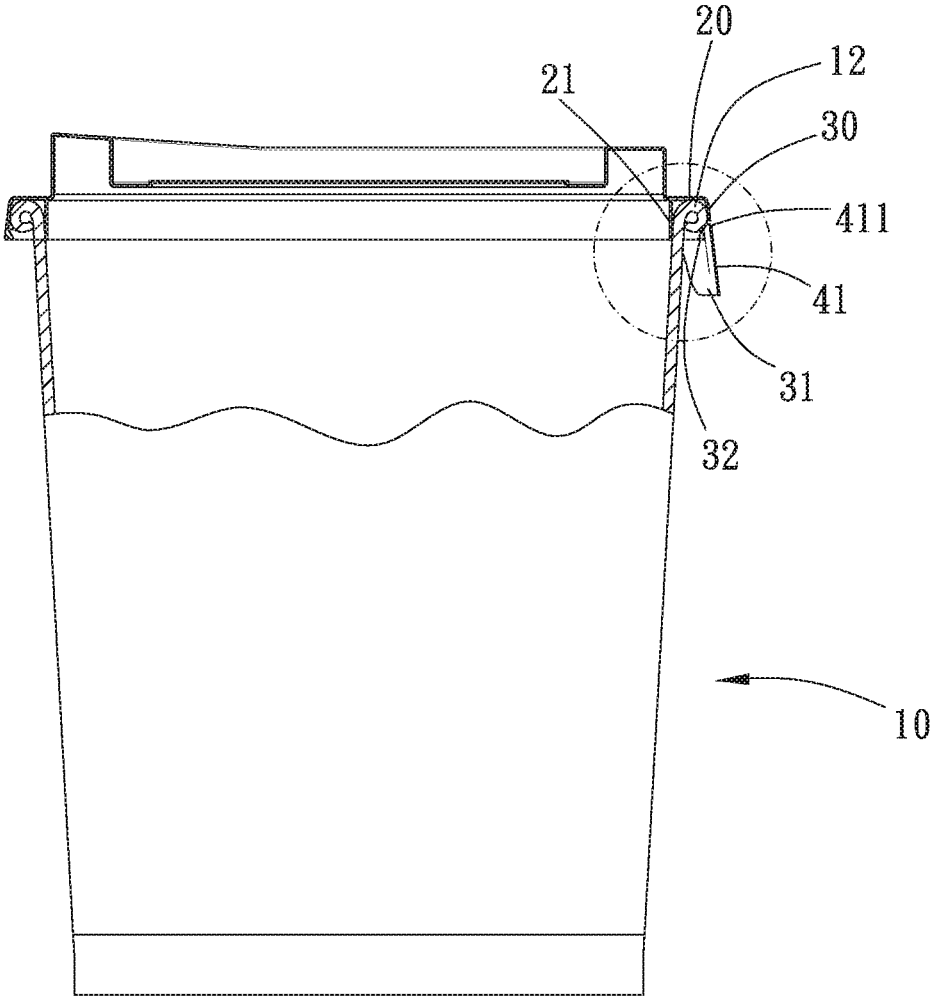
FIG. 5 is a profile showing a cup and a lid of a first embodiment of the present invention.
Figure 8:
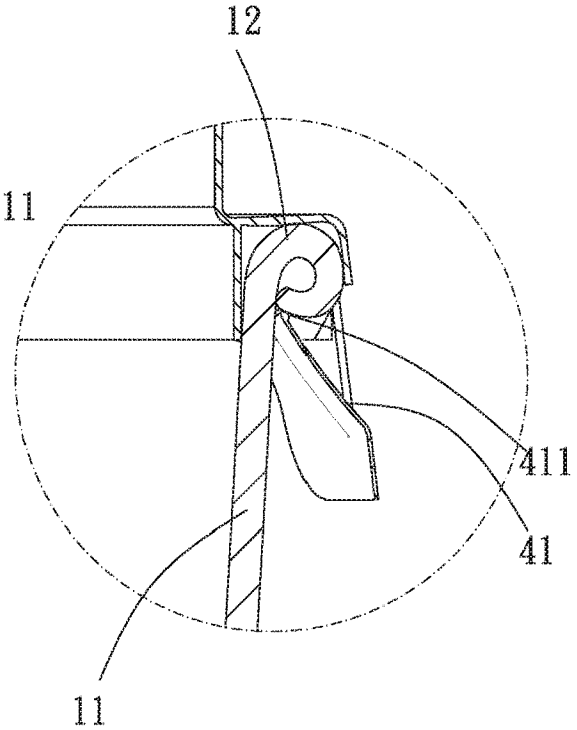
FIG. 8 is a schematic drawing showing an engagement condition of a first embodiment of the present invention.
Figure 7:
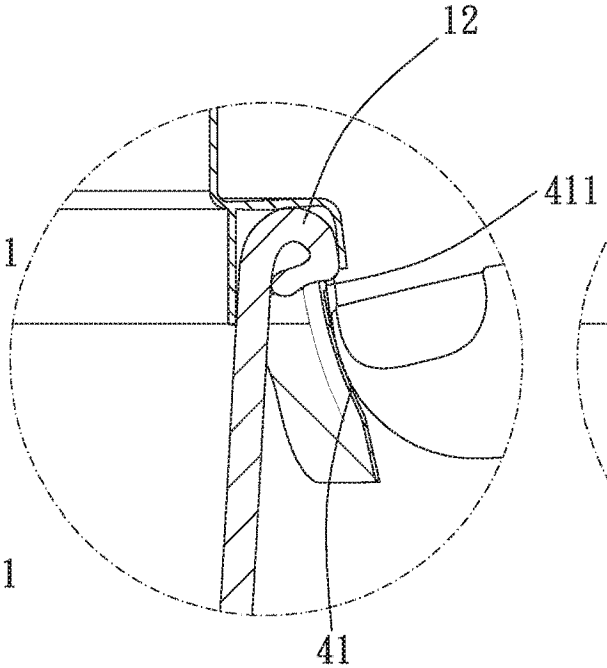
FIG. 7 is a schematic drawing showing a pressing condition of a first embodiment of the present invention.
Figure 6:
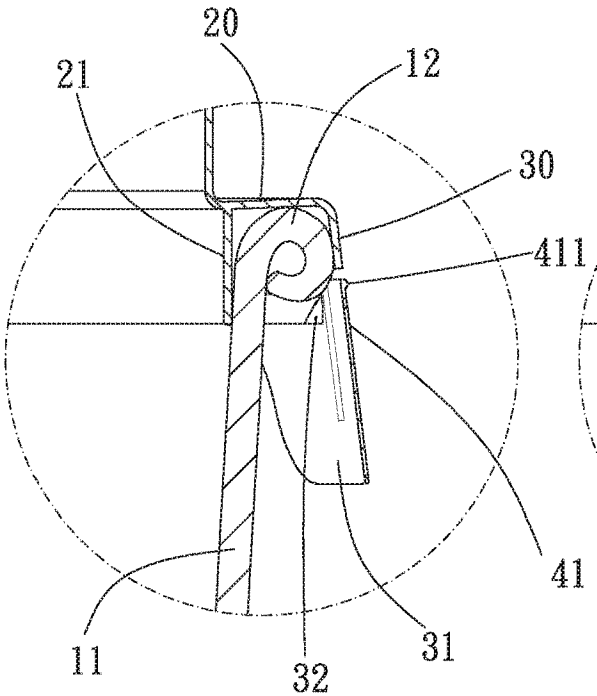
FIG. 6 is a partial enlargement drawing of FIG. 5.

Please refer to FIG. 5. Accordingly, the lid is adapted for covering a cup 10. The inner plate 21, the top portion 20, the side plate 30, and the protruding portion 32 engage and clutch at the rim flange 12. Preliminary engagement of the lid and the cup 10 is achieved, as shown in FIG. 6. Please refer to FIGS. 7 and 8. The engagement plate 41 is then pressed inwardly so that the engagement plate 41 is slightly deformed and bent. The engagement plate 41 would finally abut against both of the rim flange 12 and the body 11. Thus, the rim flange 12 is firmly engaged by the lid. Practically, the engagement plate 41 may be curved or bent to firmly abut against the rim flange 12. In other words, the side plate 30 and the engagement plate 41 as a whole are flattened. The engagement plate 41 is pivotable around the bottom edge with respect to the side plate 30 between a first position and a second position. When the engagement plate 41 is located at the first position, the engagement plate 41 and the side plate 30 are located at the same plane. When the engagement plate 41 is located at the second position, the engagement plate 41 is bent inward to clutch on the rim flange of the cup 10. The engagement plate 41 tends to retain at the first position. The engagement plate 41 is for being pressed inwardly to the second position after putting the lid on the cup 10 to clutch on a rim flange of the cup.

In engaging and clutching the rim flange 12, the engagement plate 41 is bent inwardly. The notch 412 is provided for increasing flexibility of the engagement plate 41, so that the engagement plate 41 can be bent to engage the rim flange 12 easily. In addition, the protrusion 411 is provided for thickening the top edge of the engagement plate 41. Insertion of the top edge into the seam between the rim flange 12 and the body 11 is prevented, so that the top edge is kept dismountable from the body 11 or from the cup 10.

In the present invention, the lid engages the cup 10 by clutching the rim flange 12. The engagement plate functions as claw to firmly clutch the rim flange. Even specifications of the rim flange are slightly changed, the lid can still engage with the cup well.

Figure 9:
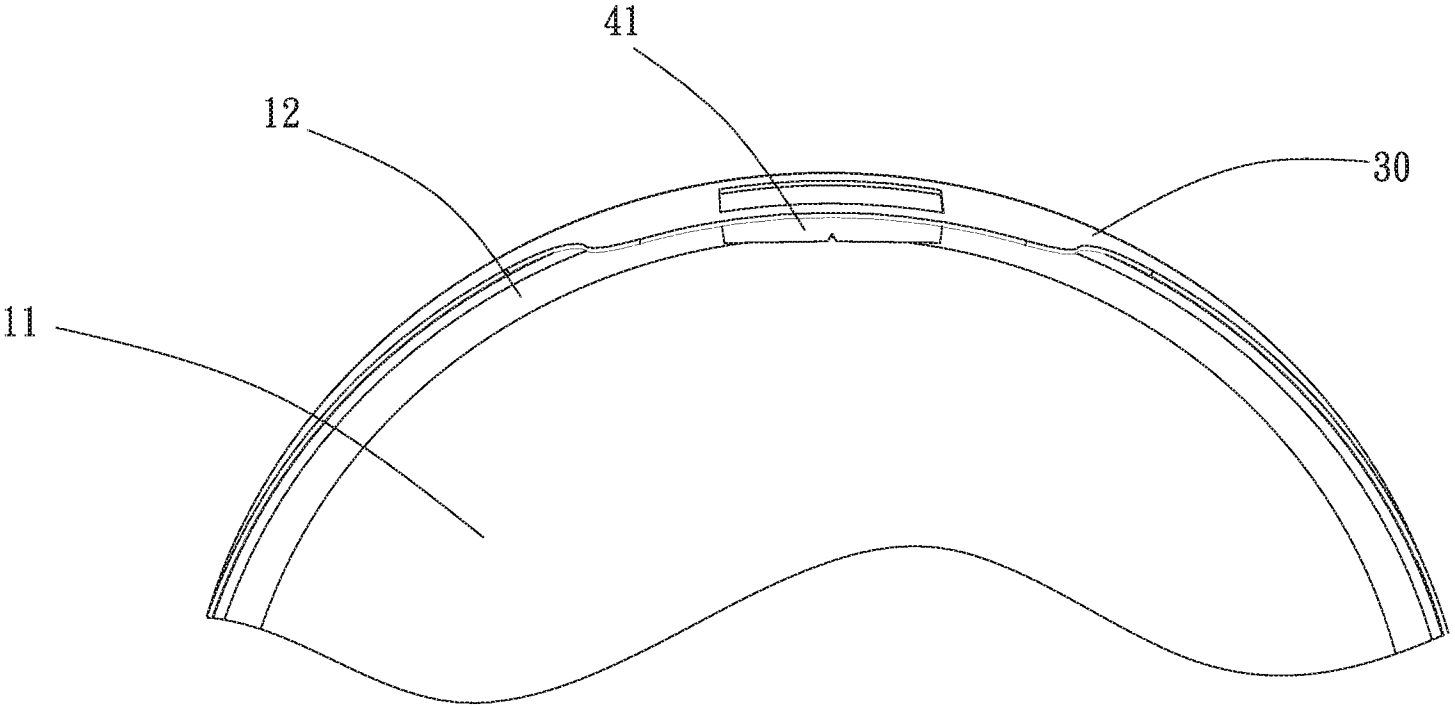
FIG. 9 is a combination drawing showing an engagement condition of a cup and a lid of a first embodiment of the present invention.

Please refer to FIG. 9. Additionally, when the engagement plate 41 engages the rim flange 12, only the central portion of the engagement plate 41 abuts against the body 11 since curvature of the top edge is greater than curvature of the bottom edge. User can pull the engagement plate 41 from two sides of the engagement plate 41 for removing the lid. Thus, lid removing can be achieved easily without destroying the lid.

The extension portions 31 of the side plate 30 are provided for user to facilitating lid removing. User can hold the extension portion and pull the extension portion outwardly. Thus, the engagement plate would be drawn back away from the body 11 so as to break the engagement relationship. Lid removing is then facilitated.

What is claimed is:

1. A lid, utilized for covering a cup, the lid comprising:

a top portion;

an annular side plate, extending downwardly from a periphery of the top portion, an axial direction and a radial direction perpendicular to the axial direction being defined by the side plate, the side plate being formed with at least a hole;

at least an engagement portion, disposed on the side plate, the engagement portion comprising an engagement plate, the engagement plate having a bottom edge and a top edge, the bottom edge extending from and being connected to the side plate, the engagement plate extending from the bottom edge upwardly along the hole so that the engagement plate is received in the hole, the engagement plate and the side plate being located at a same plane, the engagement plate being bendable, an engagement space being defined in middle of the top portion, the side plate, and the top edge of the engagement plate when the engagement plate is bent inwardly along the radial direction;

wherein a thickness of the side plate is larger than a thickness of the engagement plate, the engagement plate is deformable;

wherein the side plate and the engagement plate as a whole are flattened, the engagement plate is pivotable around the bottom edge with respect to the side plate between a first position and a second position, the engagement plate and the side plate are located at the same plane when the engagement plate is located at the first position, the engagement plate is bent inward to clutch on a rim flange of the cup when the engagement plate is located at the second position, the engagement plate tends to retain at the first position, the engagement plate is for being pressed inwardly to the second position after putting the lid on the cup to clutch on the rim flange of the cup;

wherein the side plate has at least an extension portion protruding downwardly from where the bottom edge of the engagement plate extends, a distance from a top surface of the side plate to a bottom edge of the extension portion along a direction is over two times of a dimension of the rim flange of the cup along the direction;

wherein the engagement plate is formed with a notch recessed downwardly from a middle portion of the top edge of the engagement plate;

wherein the engagement portion has a width along the axial direction larger than a width of the annular side plate along the axial direction.

2. The lid of claim 1, wherein the engagement plate is formed with a protrusion protruding radially outwardly, the protrusion is located at the top edge of the engagement plate.

3. The lid of claim 1, wherein a U-shaped gap is defined by the engagement plate and the side plate.

4. The lid of claim 1, wherein a depth of the notch is less than one-third of a width of the engagement plate along the direction.

* * * * *